US010894633B2

(12) United States Patent
Lim

(10) Patent No.: US 10,894,633 B2
(45) Date of Patent: Jan. 19, 2021

(54) COSMETIC CONTAINER

(71) Applicant: YONWOO CO., LTD., Incheon (KR)

(72) Inventor: Sung Taek Lim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 16/815,853

(22) Filed: Mar. 11, 2020

(65) Prior Publication Data

US 2020/0307864 A1 Oct. 1, 2020

(30) Foreign Application Priority Data

Mar. 28, 2019 (KR) ..... 10-2019-0035520

(51) Int. Cl.
*B65D 25/54* (2006.01)
*B65D 83/00* (2006.01)
*A45D 34/06* (2006.01)

(52) U.S. Cl.
CPC ..... *B65D 25/54* (2013.01); *A45D 34/06* (2013.01); *B65D 83/0038* (2013.01); *A45D 2200/053* (2013.01); *A45D 2200/056* (2013.01)

(58) Field of Classification Search
CPC .... B65D 25/54; B65D 1/023; B65D 83/0038; A45D 2200/053; A45D 34/06; A45D 2200/056
See application file for complete search history.

(56) References Cited

U.S. PATENT DOCUMENTS 4,116,571 A * 9/1978 Maxwell ..... B43M 11/06 401/206
4,244,364 A * 1/1981 Grushkin ..... A61M 5/1685 604/254
4,752,019 A * 6/1988 Walker ..... G01F 23/34 116/228
10,441,052 B1 * 10/2019 Tapocik ..... B65D 11/04
2005/0092761 A1 * 5/2005 Marganski ..... G01N 31/22 220/724
2006/0054634 A1 * 3/2006 Mekata ..... B65D 83/7535 222/94
2010/0187195 A1 * 7/2010 Jamieson ..... B65D 25/48 215/386
2014/0008389 A1 * 1/2014 Mekata ..... A45D 19/02 222/94
2017/0121079 A1 * 5/2017 Gerhards ..... B65D 85/70
2017/0232459 A1 * 8/2017 Dupont ..... A45D 34/02 222/383.1

FOREIGN PATENT DOCUMENTS

| | | | |
|---|---|---|---|
| JP | 06-002603 | Y2 | 1/1994 |
| JP | 3884414 | B2 | 2/2007 |
| JP | 4468220 | B2 | 5/2010 |
| KR | 10-2005-0067126 | A | 6/2005 |
| KR | 20-0463637 | Y1 | 11/2012 |
| KR | 10-2016-0023028 | A | 3/2016 |
| KR | 10-2017-0061871 | A | 6/2017 |

* cited by examiner

*Primary Examiner* — J C Jacyna

(74) *Attorney, Agent, or Firm* — Novick, Kim & Lee, PLLC; Sang Ho Lee

(57) ABSTRACT

Provided is a cosmetic container including a container body for storing contents, a discharger for discharging the contents stored in the container body to the outside, a shoulder provided on an upper side of the container body, the shoulder having a see-through part made of a transparent material through which the contents stored inside can be observed from the outside.

9 Claims, 6 Drawing Sheets

COSMETIC CONTAINER

CROSS-REFERENCE TO RELATED APPLICATIONS

This application claims the priority to Korean patent application No. 10-2019-0035520 filed on Mar. 28, 2019, the entire disclosure of which hereby incorporated by reference.

TECHNICAL FIELD

The present disclosure provides a cosmetic container making the contents in the container part visible from the outside.

BACKGROUND OF THE RELATED ART

Since the conventional tubular container is made of an opaque material, it is difficult to visually check the contents contained in the container. In particular, when the color tone of the contents need to be checked in the tubular container, it is difficult to intuitively determine what color tone the contents actually have. This is because in order to check for the color tone of the contents, the contents would need to be discharged from the tubular container, which may be a cumbersome process.

Various containers have been attempted to solve this problem. First, as shown in FIG. 6(*a*), some areas of the container may be displayed in the same color of the contents. This allows the user to look at the outside of the container to determine the color of the contents, but in reality, the color appearing on the container does not necessarily match the color of the contents, so the correct color or the sense of the color tone of the contents cannot be readily determined. In particular, in the case of various tonal contents, it is inefficient to manufacture separate containers for each of the color tones displayed by the contents in terms of manufacturing process or economics.

In addition, as shown in FIG. 6(*b*), a part of the tube may be made of a transparent material. In this case, the contents contained inside can be observed from the outside through the transparent part of the tube. However, in this case, the container part is not formed integrally, but the container part made of a transparent material and the container part made of an opaque material must be manufactured and assembled/combined separately, increasing the difficulty in manufacturing process, defect rate, and cost.

Therefore, a technique for solving this problem is required.

SUMMARY

Accordingly, the present disclosure has been made in view of the above-mentioned problems occurring in the prior art, and it is an object of the present disclosure to provide a cosmetic container that is capable of observing the contents in the container from the outside.

To accomplish the above-mentioned object, according to one or more embodiments, there is provided a cosmetic container. The cosmetic container may include a container body configured to store contents, a discharger configured to discharge the contents stored in the container body to an outside, a shoulder disposed on an upper side of the container body, and a cap disposed on the upper side of the container body and opening or sealing the discharger from the outside, wherein the shoulder includes a shoulder body disposed on an upper side of a mouth of the container body, the shoulder body having a hollow including the contents positioned inward and a see-through part made of a transparent material extending outward, wherein when the cap is coupled, the cap is disposed on an upper side of the shoulder body, the see-through part is exposed to the outside, and the cosmetic container is configured to stand supported by one surface of the cap, and wherein the contents move to the hollow of the shoulder body due to the standing, and the contents positioned in the hollow are observable from the outside through the see-through part.

The cosmetic container may further include a pump configured to move the contents in the container body to the discharger, and a head disposed on an upper side of the shoulder and having the pump inside.

The shoulder may further include a lower support extending downward from the shoulder body and configured to be inserted into and coupled to the container body, and an upper support extending upward from the shoulder body and configured to be inserted into and coupled to the head.

The contents may be positioned between an inner wall of the shoulder body and the pump and may be observable through the see-through part.

A sealing protrusion extending inward may be defined at an inner wall of the upper support, and the sealing protrusion may be configured to contact the pump and prevent the contents from leaking to an upper side of the hollow by sealing the hollow on the upper side thereof.

The container body may be of a tubular type.

The cap may have one open surface releasably coupled to the head.

The one surface of the cap may be flat.

The discharger may include a discharge hole interconnected with the pump, wherein the contents are configured to be discharged through the discharge hole, and a button configured to ascend and descend by applying an external force by a user.

According to the present disclosure, the contents can be observed from the outside through at least a portion of the shoulder made of a transparent material. As a result, it is possible to eliminate the difficulty and inefficiency involved in actually having to discharge the contents in order to check the contents or in making a part of the container from a transparent material.

Furthermore, according to the present disclosure, when the cosmetic container is made to stand owing to the cap, the contents naturally move to the inside of the shoulder, thereby enabling an observation to be made from the outside.

BRIEF DESCRIPTION OF THE DRAWINGS

Brief description on each drawing figure will be provided so that the drawing figures referenced in the detailed description may be more sufficiently understood.

DETAILED DESCRIPTION

Figure 1:
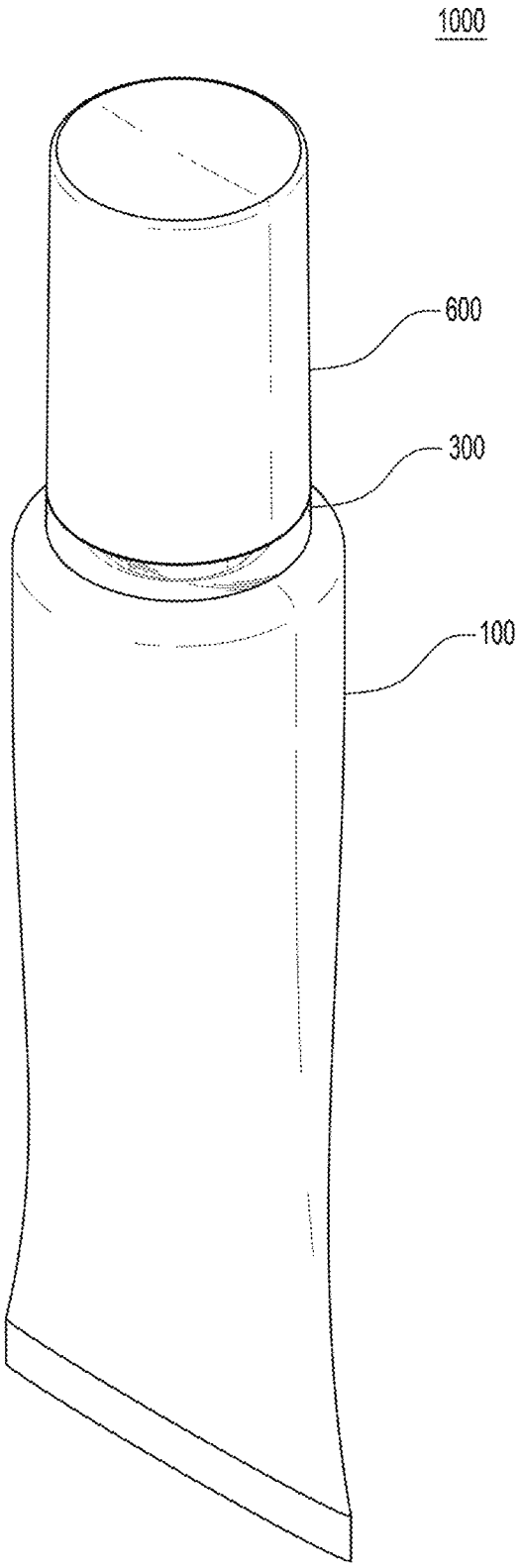
FIG. 1 shows a perspective view of a cosmetic container according to one or more embodiments of the present disclosure.

Hereinafter, example embodiments will be described with reference to the accompanying drawings; however, for reference numerals, with respect to the same elements, even though they may be displayed in different drawings, such elements use same reference numerals as much as possible. Also, in explaining the example embodiments, detailed description on known elements or functions will be omitted if it is determined that such description will interfere with understanding of the embodiments. In addition, the example embodiments may be embodied in different forms and should not be construed as limited to the embodiments set forth herein but may be modified and variously implemented by those skilled in the art.

In the drawing figures, dimensions may be exaggerated for clarity of illustration. It will be understood that when an element is referred to as being "between" two elements, it can be the only element between the two elements, or one or more intervening elements may also be present. It will be understood that when a part includes or has an element, it does not mean that other elements are excluded but that other elements may be further included. Also, in explaining elements, terms like "first", "second", "A", "B", "(a)", "(b)", etc. may be used. However, such terms are used to distinguish one from the others only and they do not affect the essence, nature, sequence, order, etc.

Figure 2:
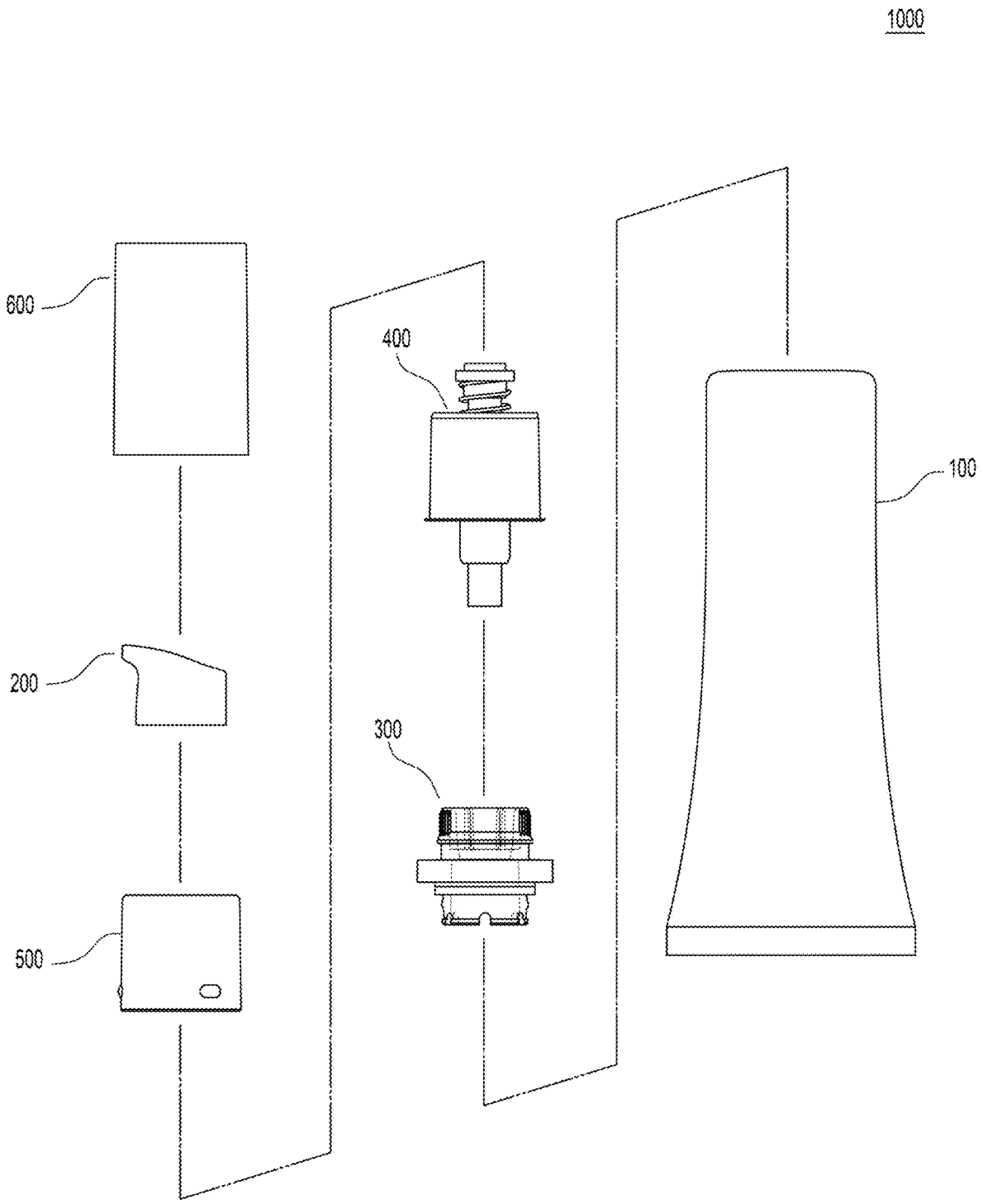
FIG. 2 shows an exploded view of a cosmetic container according to one or more embodiments of the present disclosure.
Figure 3:
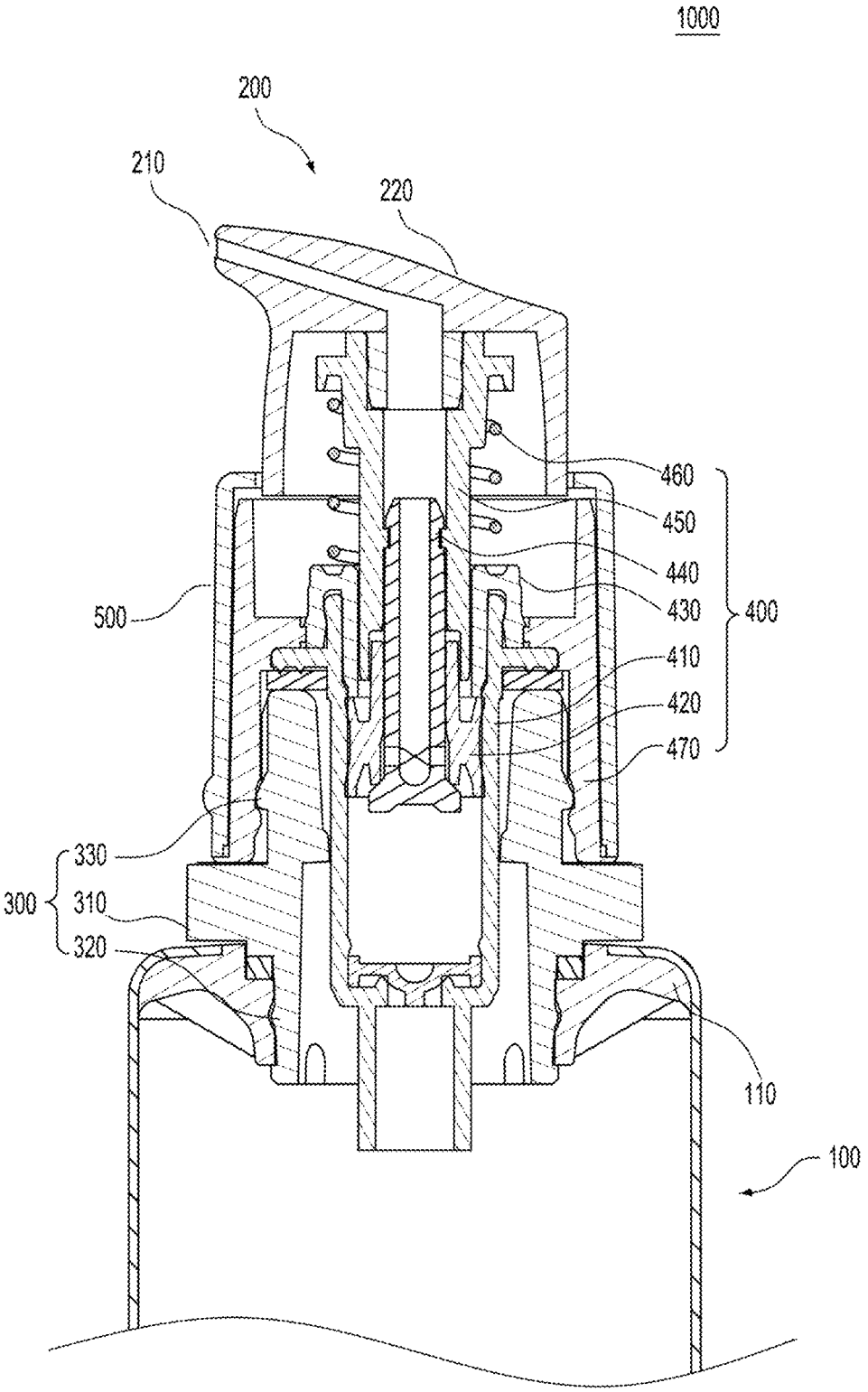
FIG. 3 shows a partial cross-sectional view of a cosmetic container according to one or more embodiments of the present disclosure.

FIG. 1 shows a perspective view of a cosmetic container according to one or more embodiments of the present disclosure. FIG. 2 shows an exploded view of a cosmetic container according to one or more embodiments of the present disclosure. FIG. 3 shows a partial cross-sectional diagram of a cosmetic container according to one or more embodiments of the present disclosure.

Referring to FIGS. 1 to 3, a cosmetic container 1000 may include a container body 100, a discharger 200, a shoulder 300, a pump 400, a head 500 and a cap 600.

A container body 100 may provide a space for receiving contents. The contents stored in the container body 100 may be discharged to the outside via the discharger 200, etc. and may be used by a user. Here, the contents may include a cosmetic product (that is, a cosmetic) or medicine; however, the types of contents are not limited thereto and may include various types or components of materials which may be stored in the container body 100 and discharged via the discharger 200. For example, but not limited thereto, the contents may be of liquid, gel, powder, etc. Although the container body 100 is illustrated as a tube type, this is for illustrative purpose only; various types of container body 100 may be applicable such as a bottle, a tottle, etc.

A shoulder 300 may be coupled to an inside of a mouth part of an upper side of the container body 100. In particular, a coupling part 110 may be provided inside of an upper part of the container body 100, and the coupling part 110 may include an upper wall having a shape in close contact with an upper inner surface of the container body 100 and an inner wall extending downward from the upper wall. On the inner wall, there may be formed a coupling groove to which a coupling protrusion of a lower support 320 of the shoulder 300 is coupled. In addition, there may be formed a locking step at a lower end of the inner wall. When the shoulder 300 is coupled to the coupling part 110, a locking protrusion of the lower support 320 of the shoulder 300 is caught by the locking step, thereby preventing the shoulder 300 from breaking away from the container body 100. At least one reinforcing member may be radially formed at a lower end of the upper wall of the coupling part 110 to maintain shapes of the upper wall of the coupling part 110 and an upper end of the container body 100 and to reinforce strength.

In one or more embodiments, a mounting groove in which the packing member is mounted may be formed inside the upper wall. When the lower support 320 of the shoulder 300 is coupled to the coupling part 110, a shoulder body 310 of the shoulder 300 presses the packing member, thereby sealing the contents of the container body 100. The packing member may be, for example, various configurations such as rubber, silicone, etc.

The discharger 200 may discharge the contents contained in the container body 100 to the outside. To this end, there may be formed a discharge hole 210 at the discharger 200. The discharge hole 210 may be interconnected with the container body 100, and the contents which are introduced from the container body 100 may be discharged via the discharge hole 210. The contents in the discharger 200 may be introduced directly or indirectly from the container body 100. For example, as shown in the drawing, the contents in the container body 100 may be introduced into the discharge hole 210 of the discharger 200 via the pump 400. In this case, the upper end of the discharger 200 may be formed with a button 220 for receiving an external force of the user. A pressing force may be transmitted to the pump 400 while the discharger 200 moves up and down by the button 220.

A shoulder 300 may be provided on the upper side of the container body 100. There may be formed a see-through part made of a transparent material or a translucent material. The contents in the shoulder 300 may be observed from the outside via the see-through part. According to the embodiments, only the see-through part that is a part of the shoulder 300 may be formed of a transparent material or a translucent material, or the entire shoulder 300 may be formed of a transparent material or a translucent material. In the latter case, an area exposed to the outside of the shoulder 300 and observable by the user may be defined as the see-through part. The shoulder 300 may include a shoulder body 310, a lower support 320, and an upper support 330.

The shoulder body 310 may be provided on the upper side of the container body 100, and the see-through part may be extended to the outside and may have a hollow inside. The contents may be located in the hollow. Therefore, the contents in the hollow can be observed from the outside through the see-through part.

The lower support 320 may extend downward from the shoulder body 310 and may be inserted into the container body 100. Here, the coupling protrusion formed on the outer surface of the lower support 320 may be coupled to the coupling groove in the coupling part 110 of the container body 100. In addition, the lower end of the lower support 320 may have a locking protrusion formed outside that is caught on the locking jaw of the lower end of the coupling part 110. At least one buffering groove may be formed in the locking protrusion along the circumference thereof to allow the locking protrusion to easily reach the locking jaw through the inner wall of the coupling part 110.

The upper support 330 may extend upward from the shoulder body 310. An inner part of the upper support 330 may be formed with a sealing protrusion extending inwardly to contact the pump 400. The sealing protrusion seals the hollow from the upper side together with the pump 400 (particularly, the outer wall of the cylinder 410), thereby preventing the contents from leaking out from the upper side. In addition, a coupling protrusion may be formed on an outer side of the upper support 330. The coupling protrusion of the upper support 330 may be coupled to the coupling groove formed in the pump housing 470 of the pump 400.

The pump 400 may move the contents in the container body 100 to the discharger 200. The pump 400 may allow the contents in the container body 100 to flow in through the pressure change therein to be discharged to the outside through the discharger 200. The change in pressure of the pump 400 may be due to the pressurization of the user applied to the button 220 of the discharger 200. The pump 400 may include a cylinder 410, a piston 420, a sealing part 430, a stem 440, a shaft 450, an elastic member 460, and a pump housing 470.

The cylinder 410 may be disposed inside the shoulder 300 and have an upper end and a lower end that are penetrated or passed through to provide a space through which contents are introduced and exited. The cylinder 410 may have an outer diameter smaller than the hollow of the shoulder 300, and thus may allow the contents to be positioned outside the cylinder 410. The contents present between the hollow and the cylinder 410 can be observed from the outside through the shoulder 300 (particularly the see-through part of the shoulder 300). At this time, one area of the outer surface of the cylinder 410 may be in close contact with the sealing protrusion of the upper support 330 of the shoulder 300, and the contents outside of the cylinder 410 can be prevented from flowing out. Although the cylinder 410 is located in the hollow of the shoulder 300, the sealing portion of the upper support 330 pressurizes the outer wall of the cylinder 410, thereby preventing the flow in the hollow of the cylinder 410. An edge part may be formed on an outer side along the circumference of the upper side of the cylinder 410. The edge part may be supported by an inner support part of the pump housing 470 located on the upper side of the edge part to fix the position of the cylinder 410. The upper end of the cylinder 410 may be combined with the sealing part 430. The lower end of the cylinder 410 may extend toward the inside of the container body 100, and an inlet interconnected with the container body 100 may be formed. A valve may be provided in the inlet or adjacent the inlet. The valve may be a non-return valve, which seals the inlet when the internal pressure of the cylinder 410 is positive, and opens the inlet when the internal pressure of the cylinder 410 changes to negative pressure.

The piston 420 is for opening and closing the stem 440, the outer surface may be in close contact with the cylinder 410, and the inner surface may be in close contact with the stem 440. In this case, the friction force acting on the outer surface of the piston 420 may be greater than the friction force acting on the inner surface of the piston 420. The lower end of the inner surface of the piston 420 may be in close contact with the supporting part of the stem 440 to seal the inlet of the stem 440. When the stem 440 is descended with respect to the piston 420, the inlet may be opened while the lower end moves away from the supporting part of the stem 440, so that the inlet can be interconnected with the interior of the cylinder 410.

The sealing part 430 may be coupled to the upper end of the cylinder 410, and the lower end may be configured to extend to the inside of the cylinder 410, thereby suppressing the rise of the piston 420. Downwardly curved outer walls may be formed outside the sealing part 430. An upper end of the cylinder 410 may be inserted into a space formed between the inner wall and the outer wall of the sealing part 430. In particular, the groove formed inside of the outer wall of the sealing part 430 may be coupled to the protrusion formed on the outer wall of the cylinder 410. In addition, a protrusion supporting the horizontal support of the pump housing 470 may be formed on the outer wall of the sealing part 430 to the outside.

A stem 440 is provided inside the cylinder 410, the lower side is surrounded by the piston 420, and the upper side may be connected to the shaft 450. The stem 440 has a hollow tubular shape, an inlet opening and closing by the piston 420 may be formed at the lower side of the stem 440, and an outlet through which the contents introduced through the inlet flows out may be formed at an upper side of the stem 440. In addition, a support may be formed at the lower end of the stem 440, so when the lower end of the inner surface of the piston 420 is in close contact with the support, the inlet can be sealed from the inner space of the cylinder 410. The stem 440 may move up and down in the cylinder 410 by the shaft 450. When the stem 440 moves downward, the inlet is opened while the lower end of the inner surface of the piston 420 is spaced apart from the support so that the contents of the cylinder 410 may be introduced into the stem 440. If the stem 440 continues to move, the contents may be discharged through the outlet and then discharged through the discharge hole 210 of the discharger 200 via the shaft 450. When the stem 440 moves upward, the cylinder 410 may seal the inlet of the stem 440, and a negative pressure is generated inside the cylinder 410, so that the contents in the container body 100 may be introduced into the cylinder 410.

The shaft 450 may have a lower end coupled to the stem 440 and an upper end coupled to the discharger 200. The shaft 450 may move up and down by being interlocked with the discharger 200 and the stem 440. At the upper end of the shaft 450, a wing part may protrude along the outer circumferential surface. An elastic member 460 may be provided at the bottom of the wing part.

The elastic member 460 may restore the position of the shaft 450, the stem 440 interlocked with the shaft 450 and the discharger 200. The elastic member 460 may be provided between the shaft 450 and the sealing part 430. The upper end of the elastic member 460 may be in close contact with the lower surface of the wing part of the shaft 450, and the lower end may be in close contact with the receiving groove of the upper surface of the sealing part 430. When the user presses the discharger 200, the discharger 200 and the shaft 450 move downward, and the elastic member 460 is compressed. When the user releases the pressure, the elastic force of the elastic member 460 may recover the shaft 450 and the discharger 200 upward. For example, the elastic member 460 may be configured as a spring, but is not limited thereto. In accordance with one or more embodiments, various elastic materials may be used. In addition, as long as the elastic member 460 is capable of restoring the position of the discharger 200, an implementation type or an installation position may not be particularly limited.

The pump housing 470 may provide a space for receiving at least a portion of other components in the pump 400, for example, the cylinder 410, the piston 420, the sealing part 430, the stem 440, the shaft 450, and the elastic member 460. The pump housing 470 may have a lower end mounted at the upper end of the shoulder body 310 of the shoulder 300, and a coupling groove is formed at an inner side thereof, so that the pump housing 470 may be engaged with a coupling protrusion formed at an outer wall of the upper support 330 of the shoulder 300. In addition, the outer surface of the pump housing 470 may be in close contact with the inner surface of the head 500.

In one or more embodiments, the pump 400 may further include a packing member. The packing member may be located between the edge part of the cylinder 410 and the upper support 330 of the shoulder 300. The packing member may allow the cylinder 410 and the shoulder 300 to be firmly in close contact with each other, and also secondarily prevent the contents inside the hollow of the shoulder 300 from leaking to the outside. The packing member may include, for example, various configurations such as rubber, silicone, etc.

The head 500 may be provided at an upper side of the shoulder 300, and the pump 400 may be provided inside. The head 500 may cover the pump 400 therein, and the upper end thereof may be opened to provide a space in which the discharger 200 may move up and down. At least one coupling protrusion is formed outside the head 500, and the cap 600 may be detachably coupled.

The cap 600 may open or seal the discharger 200 from the outside. To this end, the cap 600 may be open on one side, and the other side may be sealed, and the one side may be detachably coupled to the head 500. In this case, the cosmetic container 1000 may stand, supported by the other surface of the cap 600. As such, the contents in the container body 100 may be moved inside the shoulder 300. This is to allow the contents of the inside of the shoulder 300 to be observed from the outside through the see-through part. The other surface of the cap 600 for standing by the cap 600 may be formed of, for example, a flat plate, but is not limited thereto, and various configurations may be applied to the cap 600 according to one or more embodiments.

In one or more embodiments, unlike the fact that at least a portion of the shoulder 300 is made of a transparent or translucent material, other components of the cosmetic container 1000 may be made of an opaque material. However, this is merely an example, and at least some of the other components of the cosmetic container 1000 may be made of a transparent or translucent material like the shoulder 300.

In one or more embodiments, the cosmetic container 1000 may be implemented without the pump 400. That is, the cosmetic container 1000 may include a container body 100, a discharger 200, a shoulder 300, a head 500, and a cap 600, and the contents of the container body 100 may be discharged via the discharger 200 after passing through the shoulder 300 and the head 500. Contents inside the shoulder 300 are observable from the outside, and in the embodiment, at least a portion of the shoulder 300, the head 500, and the discharger 200 may be combined with or integrally formed with each other.

The coupling method between the above-mentioned components is illustrative, and various configurations may be applied in one or more embodiments. For example, at the time of fitting engagement between the projection and the groove, the formation position or shape of the projection and the groove may be changed, and screw coupling may be applied instead of the fitting coupling.

Figure 4:
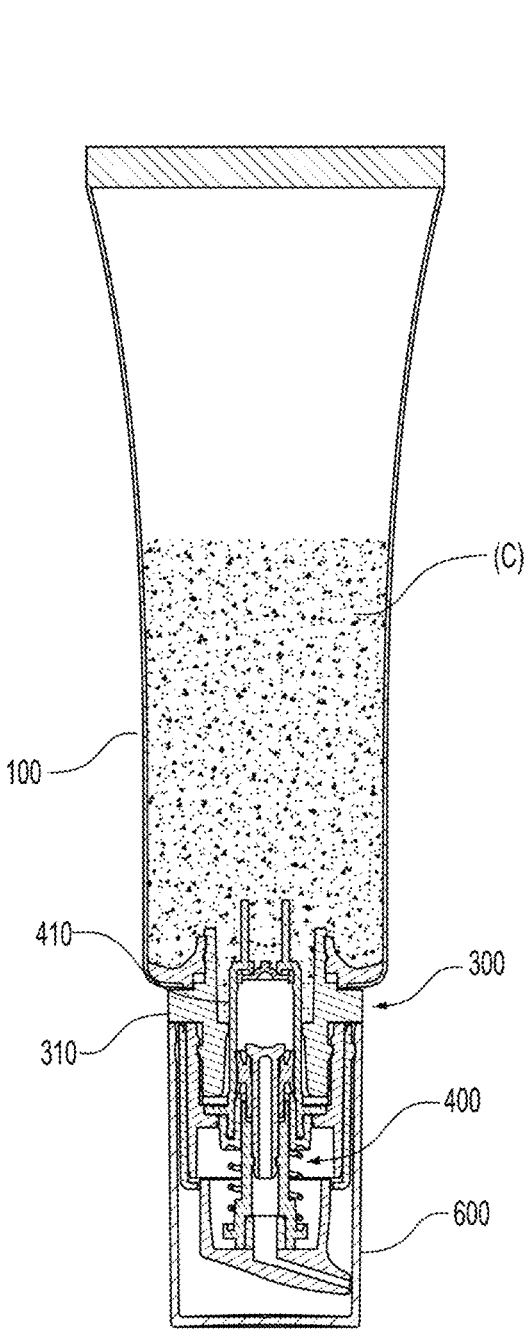
FIG. 4 shows a state of use of a cosmetic container according to one or more embodiments of the present disclosure.
Figure 5:
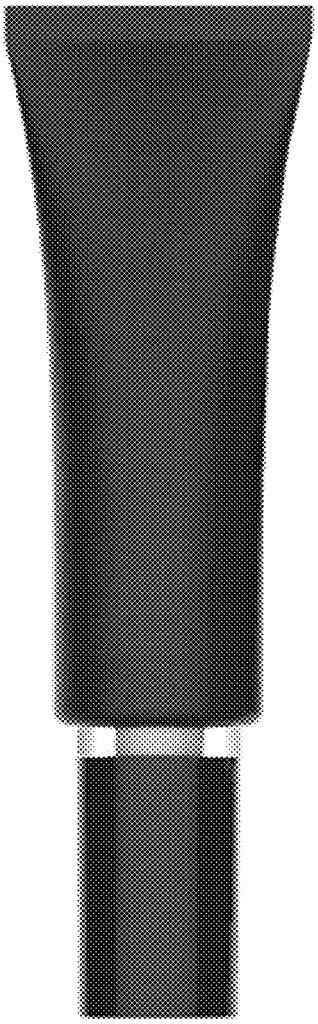
FIG. 5 shows an example of the cosmetic container in one or more embodiments of the present disclosure.
Figure 6:
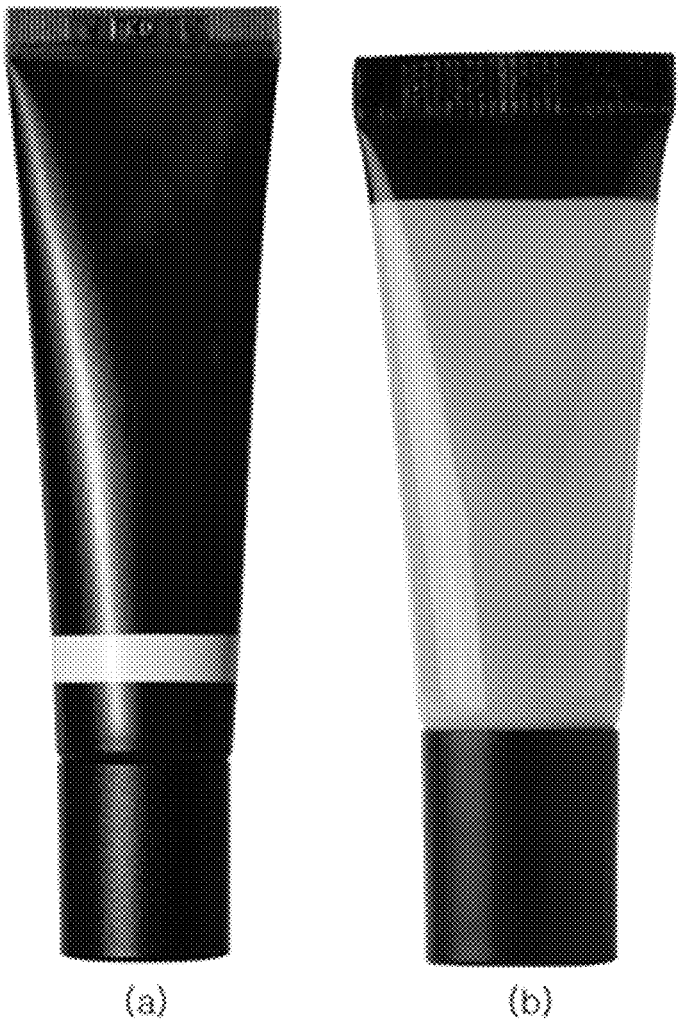
FIG. 6 PRIOR ART
FIG. 6 shows conventional tubular cosmetic containers.

FIG. 4 shows the state of use of the cosmetic container 1000 in one or more embodiments of the present disclosure, and FIG. 5 shows an example of the cosmetic container 1000 in one or more embodiments of the present disclosure.

Referring to FIGS. 4 and 5, the cosmetic container 1000 may stand, supported by the cap 600 in a state in which the cap 600 is coupled. Even if the container body 100 is implemented in a tube type, it may stand, owing to the cap 600. In particular, the tube-type container body 100 may stand, owing to the cap 600, and the standing of the container body 100 by the cap 600 may be the main or general form when it involves the state of preservation or maintenance.

As illustrated, when the cosmetic container 1000 stands by the cap 600, the contents C in the container body 100 may move toward the shoulder 300. At this time, the sealing protrusion formed on the upper support 330 of the shoulder 300 can prevent the contents C from moving further downward while contacting the outer wall of the cylinder 410 of the pump 400. The contents C are disposed in a space between the shoulder body 310 of the shoulder 300 and the cylinder 410 of the pump 400, and thus can be observed from the outside through the see-through part of the shoulder body 310.

As described above, in the present disclosure, since the contents C can be observed through the see-through part of the shoulder body 310, the contents C do not need to be discharged, or a part of the container body 100 does not need to be made transparent for a user to confirm that there remain the contents C therein. In addition, by having components other than the shoulder 300 opaque, it is possible to prevent the internal configuration of the cosmetic container 1000 be unnecessarily exposed.

On the other hand, with reference to FIGS. 4 and 5, the observation process of the contents during the standing of the cosmetic container 1000 by the cap 600 has been described, but this is illustrative only, and it is evident that the contents inside the shoulder 300 can be observed from outside in a state or position where the contents are located inside the shoulder 300 through the shoulder 300.

As described above, an optimal implementation example has been disclosed in the drawings and specification. Although acts in a particular order are shown in the figures, it should not be understood that these acts are performed in the specific order shown, or in a sequential order, or that all illustrated acts need to be performed to achieve the desired result.

In addition, although specific terms are used, they are used for the purpose of describing the present disclosure only and are not used to limit the scope of the present disclosure described in the claims. Therefore, those skilled in the art will appreciate that various modifications and equivalent embodiments are possible without departing from the scope of the present disclosure. Accordingly, the true scope of the present disclosure should be determined by the technical idea or concept of the claims.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims.

The invention claimed is:

1. A cosmetic container, comprising:

a container body configured to store contents and made of an opaque material such that the contents stored therein are not observable from an outside;

a discharger configured to discharge the contents stored in the container body to the outside;

a shoulder disposed on an upper side of the container body; and a cap configured to couple to an upper side of the shoulder which opens and seals the discharger from the outside, wherein the shoulder comprises a shoulder body disposed on an upper side of a mouth of the container body, the shoulder body having a hollow communicating with an inside of the container body including the contents positioned inward and a see-through part made of a transparent material extending outward, wherein when the cap is coupled, the cap is disposed on an upper side of the shoulder body, the see-through part is exposed to the outside, and the cosmetic container is configured to stand supported by one surface of the cap, and wherein when the cosmetic container stands on the one surface of the cap, the contents move from the container body to the hollow of the shoulder body and the contents positioned in the hollow are observable from the outside through the see-through part of the shoulder body.

2. The cosmetic container of claim 1, further comprising:

a pump configured to move the contents in the container body to the discharger; and a head disposed on an upper side of the shoulder and having the pump inside.

3. The cosmetic container of claim 2, wherein the shoulder further comprises:

a lower support extending downward from the shoulder body and configured to be inserted into and coupled to the container body; and an upper support extending upward from the shoulder body and configured to be inserted into and coupled to the head.

4. The cosmetic container of claim 3, wherein the contents are positioned between an inner wall of the shoulder body and the pump and are observable through the see-through part.

5. The cosmetic container of claim 4, wherein a sealing protrusion extending inward is defined at an inner wall of the upper support, and the sealing protrusion is configured to contact the pump and prevent the contents from leaking to an upper side of the hollow by sealing the hollow on the upper side thereof.

6. The cosmetic container of claim 1, wherein the container body is of a tubular type.

7. The cosmetic container of claim 2, wherein the cap has one open surface releasably coupled to the head.

8. The cosmetic container of claim 7, wherein the one surface of the cap is flat.

9. The cosmetic container of claim 2, wherein the discharger comprises:

a discharge hole interconnected with the pump, wherein the contents are configured to be discharged through the discharge hole; and a button configured to ascend and descend by applying an external force by a user.

* * * * *